US007520221B2

(12) United States Patent
Ameshofer

(10) Patent No.: US 7,520,221 B2
(45) Date of Patent: Apr. 21, 2009

(54) DEVICE FOR SECURING A TURNING AXLE OF A TYPE UNIT

(75) Inventor: Manfred Ameshofer, Peuerbach (AT)

(73) Assignee: Colop Stempelerzeugung Skopek Gesellschaft m.b.H. & Co. KG., Wels (AT)

( * ) Notice: Subject to any disclaimer, the term of this patent is extended or adjusted under 35 U.S.C. 154(b) by 111 days.

(21) Appl. No.: 11/794,643

(22) PCT Filed: Jan. 18, 2006

(86) PCT No.: PCT/AT2006/000026

§ 371 (c)(1),
(2), (4) Date: Jul. 2, 2007

(87) PCT Pub. No.: WO2006/079130

PCT Pub. Date: Aug. 3, 2006

(65) Prior Publication Data

US 2008/0087180 A1 Apr. 17, 2008

(30) Foreign Application Priority Data

Jan. 25, 2005 (AU) ..... A 105/2005

(51) Int. Cl.
*B41K 1/36* (2006.01)

(52) U.S. Cl. ..... 101/334; 101/405; 101/104

(58) Field of Classification Search ..... 101/334, 101/327, 333, 405, 103, 104, 105
See application file for complete search history.

(56) References Cited

U.S. PATENT DOCUMENTS

| | | | | |
|---|---|---|---|---|
| 1,401,436 | A | 12/1921 | Pannier | 101/334 |
| 4,432,281 | A | 2/1984 | Wall et al. | 101/105 |
| 6,067,905 | A | 5/2000 | Faber | 101/334 |
| 6,453,813 | B1 | 9/2002 | Faber | 101/405 |
| 2007/0012206 | A1 * | 1/2007 | Pointl | 101/334 |

FOREIGN PATENT DOCUMENTS

| | | | |
|---|---|---|---|
| AT | 005 826 | U1 | 12/2002 |
| DE | 1 906 426 | A | 11/1969 |
| WO | WO 99/16624 | A | 4/1999 |
| WO | WO 99/28132 | A | 6/1999 |
| WO | WO 00/21759 | A | 4/2000 |

OTHER PUBLICATIONS

International Search Report dated May 31, 2006.

* cited by examiner

*Primary Examiner*—Leslie J Evanisko
(74) *Attorney, Agent, or Firm*—Collard & Roe, P.C.

(57) ABSTRACT

A device for securing a turning axle (9) of a type unit (3) to an actuating bow (5) of a self-inking stamp (1) having a turning mechanism (2), with at least one bushing-shaped axle-securing member (12) which, in the mounted position, is slid onto an end region of the turning axle (9) with a bushing body (95) and externally contacts the actuating bow (5) with a radial projection (96), wherein the bushing body (95) includes at least one tongue-like, resiliently radially deflectable snap-in element (98) with a radially inwardly oriented snap-in projection (99) which, in the mounted position, engages in a snap-in depression (101) provided as corresponding snap-in element in the turning axle (9) in the end region of the latter.

11 Claims, 9 Drawing Sheets

DEVICE FOR SECURING A TURNING AXLE OF A TYPE UNIT

CROSS REFERENCE TO RELATED APPLICATIONS

Applicant claims priority under 35 U.S.C. §119 of Austrian Application No. A 105/2005 filed Jan. 25, 2005. Applicant also claims priority under 35 U.S.C. §365 of PCT/AT2006/000026 filed Jan. 18, 2006. The international application under PCT article 21(2) was not published in English.

TECHNICAL FIELD

The invention relates to a device for securing a turning axle of a type unit to an actuating bow of a self-inking stamp having a turning mechanism, with at least one bushing-shaped axle-securing member which, in the mounted position, is slid to an end region of the turning axle with a bushing body and externally contacts the actuating bow with a radial projection, preferably with a radial flange projection.

BACKGROUND OF THE INVENTION

From DE 19 06 426 A, a self-inking stamp with upper inking is known in which a type unit with a set of bands is passed through by a turning axle (control axle) which turning axle is secured on its two ends on an external actuating bow by means of bushing-shaped axle-securing members, termed bearing bushings there. The turning axle is movable in a stamp housing along control slots upon pressing down the actuating bow relative to the stamp housing, in which case then the type unit is displaced downwards and, at the same time, is pivoted by 180° from an upper inking position into a lower stamp imprint position. The axle securing members are formed by a simple, smooth tubular body, which is followed outwardly by a radial flange projection that contacts the outer side of the respective leg of the actuating bow. These known axle securing members must be seated on the turning axle with an intimate frictional fit, which may be a problem since, usually, the turning axle is made of steel having a smooth surface and the axle securing members are made of a synthetic material of comparatively high strength and rigidity, respectively, so that due to production tolerances or due to wear during the use of the stamp, the tight fit of the bushing-shaped axle securing parts on the turning axle is not ensured. Moreover, in known stamps it is provided for the turning axle to be designed with a broadened head on one, which head is contacted by the adjacent axle securing member, which does result in an improved safety when the turning axle is held in the bow, yet it also means objectionable additional expenditures during production of the turning axle.

In WO 99/16624, a self-inking stamp with a turning mechanism is disclosed, the turning axle of which is secured in the legs of said bow with the help of shaped bodies which are snapped into recesses of the legs of the actuating bow. In its secured state, the turning axle is partially mounted in the respective leg and partially mounted on said shaped body, the leg having a bearing shell which engages in a peripheral groove of the turning axle, and wherein the turning axle and the bearing shell are kept in mutual engagement by the inserted shaped body. By the fact that the bearing of the turning axle is respectively effected by two separate structural components, i.e. the bearing shell and the shaped body, these two structural components as well as the opening in the leg of the bow must be produced quite accurately in order to ensure an adequate rotational mounting of the turning axle.

Finally, from WO 00/21759 A, an axle securing means for an end of a turning axle in an opening in a leg of an actuating bow of a self-inking stamp is known, wherein the axle securing member proper is an external ring which is segmented and which engages in a groove of the turning axle by means of radial inner flange parts and which ring, preferably, is integrally formed with a bearing bushing part. This bearing bushing part itself, however, is designed with a smooth inner surface. In this embodiment, however, because of the necessarily short lever arms, the ring segments serving as snap-in elements are comparatively difficult to dimension with regard to the elastic deformation required for snapping-in.

BRIEF SUMMARY OF THE INVENTION

It is now an object of the invention to remedy this situation and to propose a device for securing a turning axle of a type unit in a self-inking stamp, which, with a simple design and a low-cost production of the individual components, nevertheless ensures snap-in engagement of the axle securing member without any problems as well as a secure retention of the turning axle in the actuating bow. At the same time, furthermore, an advantageous rotational mounting of the turning axle in the actuating bow shall be rendered possible by the bushing-shaped axle securing part(s).

To achieve the aforementioned object, the invention provides for a securing device as defined in claim 1. Advantageous embodiments and further developments of this securing device are indicated in the dependent claims.

With the technique according to the invention, simple, yet nevertheless reliable securing of the turning axle on the actuating bow of the respective stamp by snapping engagement can be attained, wherein the axle securing member at the same time acts a bearing body, or bearing intermediate body, respectively, for rotation and displacement of the turning axle in a receiving or passage opening in the actuating bow, or in a slot opening in the stamp housing, respectively. The axle securing members may simply be slid on the ends of the turning axle from the outside after the turning axle has been passed through the actuating bow, the stamp housing and the type unit, said axle securing members being simultaneously inserted into the receiving openings in the actuating bow as well as into the slot openings in the stamp housing. In the pre-determined position of operation, the tongue-like snap-in elements of the bushing body then snap into the snap-in depression of the turning axle, wherein furthermore the axle securing members, by means of the respective radial flange projection, abut externally in the region of the rim of the opening on the actuating bow, i.e. on its respective leg, whereby the turning axle reliably is retained in the actuating bow.

If the actuating bow is comprised of two parts which are pushed into each other, in particular of an outer, upper metal bow part and an inner bow part that embraces the edges of the metal bow part by means of rim ledges, in particular made of synthetic material, with the help of the axle securing members also holding together the ends of the bow legs of the two bow parts can be achieved at the same time.

In terms of production it is suitable if the or each tongue-like snap-in element is provided in a window of the bushing body and integrally follows on the bushing body at one end thereof.

With a view to slipping the respective axle securing member on, it is also advantageous if the freely cantilevering end of the tongue-like snap-in element in the operating position is the outer end of the snap-in element, whereas the tongue-like snap-in element on the further inwardly located end integrally merges into the remaining bushing body.

Suitably, the snap-in projection is provided on the freely cantilevering end of the tongue-like snap-in element. The snap-in depression in the turning axle could be formed by individual, discrete recesses on the circumference of the turning axle, which, however, may require an appropriate orientation of the axle securing member relative to the turning axle during mounting of the former (by relative rotation). In order to render possible slipping on of the axle securing members in an arbitrary position of rotation relative to the turning axle, it is therefore particularly advantageous if the snap-in depression in the turning axle is formed by an annular groove.

For reasons of strength, the turning axle preferably is made of metal, in particular steel. For instance, a chromium-plated or nickel-plated steel may be used for the turning axle. For a stable snap-in engagement of the axle securing members on the turning axle, it is furthermore suitable if the bushing body has two diametrically oppositely arranged tongue-like snap-in elements.

An embodiment which is particularly advantageous in terms of production is obtained if the bushing body is integrally formed together with the radial projection and the, or each, snap-in element of a synthetic material, preferably POM (polyoxymethylene). In this case, it is furthermore suitable if the bushing body with the radial projection and the or each snap-in element is an injection-molded member.

The respective axle securing member could have a continuous front wall on its outer side, which merges into the radial projection, or flange-projection, respectively, and which encloses and covers the respective front side of the turning axle. However, to facilitate, if required, an optional detachment of the axle securing members from the turning axle with the help of an appropriate tool, and, moreover, to make the production easier, it has proven advantageous if the axle securing member has an opening passing therethrough for slipping it onto the turning axle. In this context, by means of a thin-walled tubular member which is inserted from the front side, from the outside, through the opening of the axle securing member in direct peripheral contact with the turning axle, detachment of the tongue-like snap-in elements from the turning axle can be effected, so that then the axle securing member can be pulled off the turning axle.

BRIEF DESCRIPTION OF THE DRAWING

In the following, the invention will be explained in more detail by way of particularly preferred exemplary embodiments to which, however, it shall not be restricted, and with reference to the drawing. In the drawing, in detail.

DETAILED DESCRIPTION OF THE DRAWING

Figure 1:
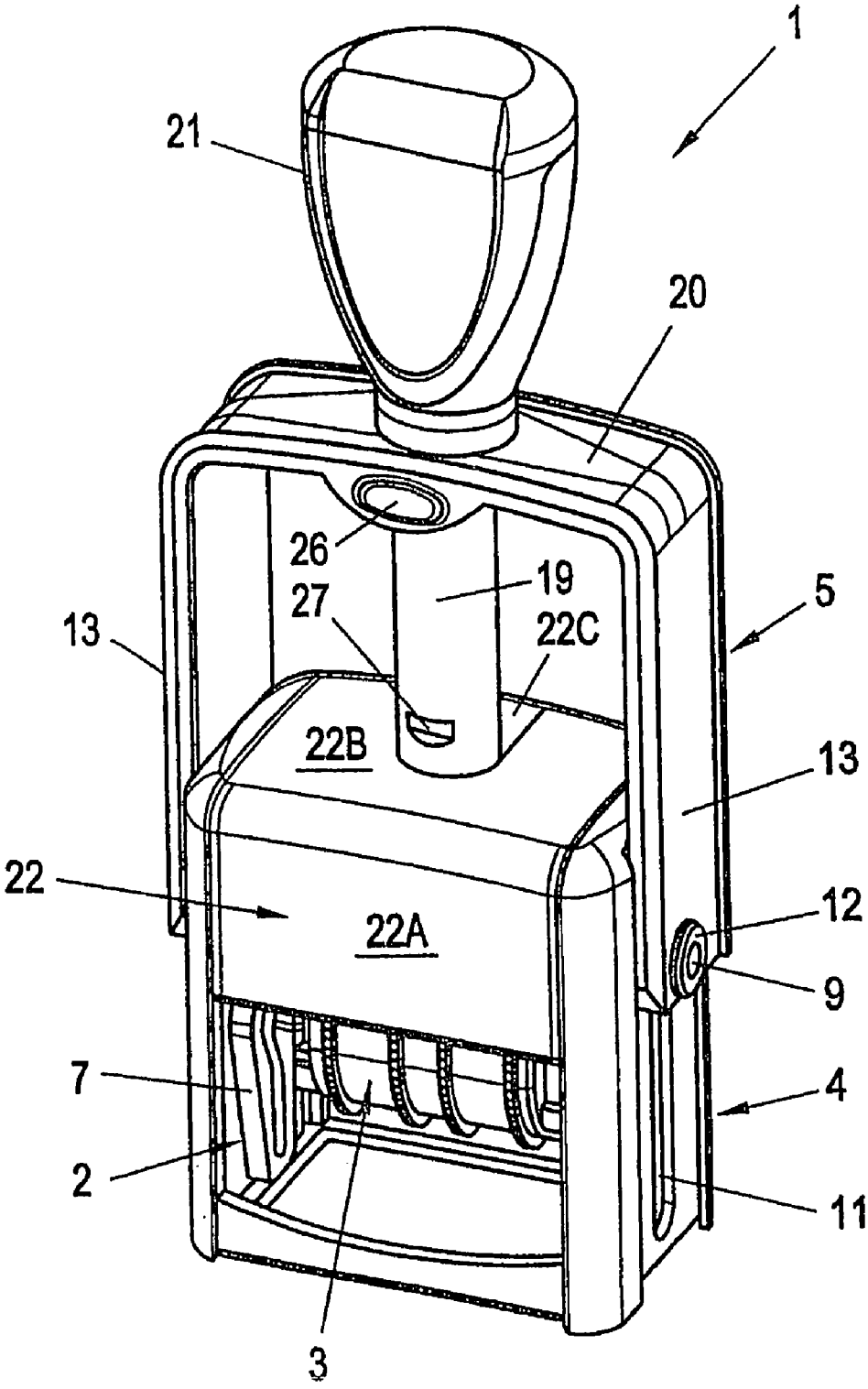
FIGS. 1 and 2 show perspective views of a self-inking stamp with a stamp unit including several type bands, seen from two different sides.

In FIGS. 1 to 4, a self-inking stamp 1 with upper inking having a per se common basic construction and function is illustrated, which comprises a turning mechanism 2 for a stamp type unit 3. With the help of an actuating bow 5, the type unit 3 is upwardly and downwardly movable in a stamp housing 4 formed of two parts 4A, 4B and, thus, starting from an upper resting position illustrated in FIGS. 1, 2 and 4, in which the stamp types (not visible in FIGS. 1 to 4, yet cf. FIG. 6) contact an ink pad soaked with stamping ink within a drawer-like container 6 that can be pushed into and out of the stamp housing 4, is movable by 180° into a lower, turned imprinting position. The construction of the turning mechanism 2 is known per se, cf. e.g. U.S. Pat. No. 1,401,436 A or U.S. Pat. No. 4,432,281 A, and has rocker-shaped turning members 7 which are pivotably mounted on its upper end and each have a curved control slot 8 for a turning axle 9. In the assembled state, this turning axle 9 extends through a base member 10 of the type unit 3, cf. also FIG. 6 in addition to FIG. 4; furthermore, the turning axle 9 extends through longitudinal slots 11 or 11A, 11B, respectively (cf. FIG. 4) of the stamp housing 4, and it is fixed by means of bushing-type axle securing members 12 in legs 13 of the actuating bow 5.

Figure 5:
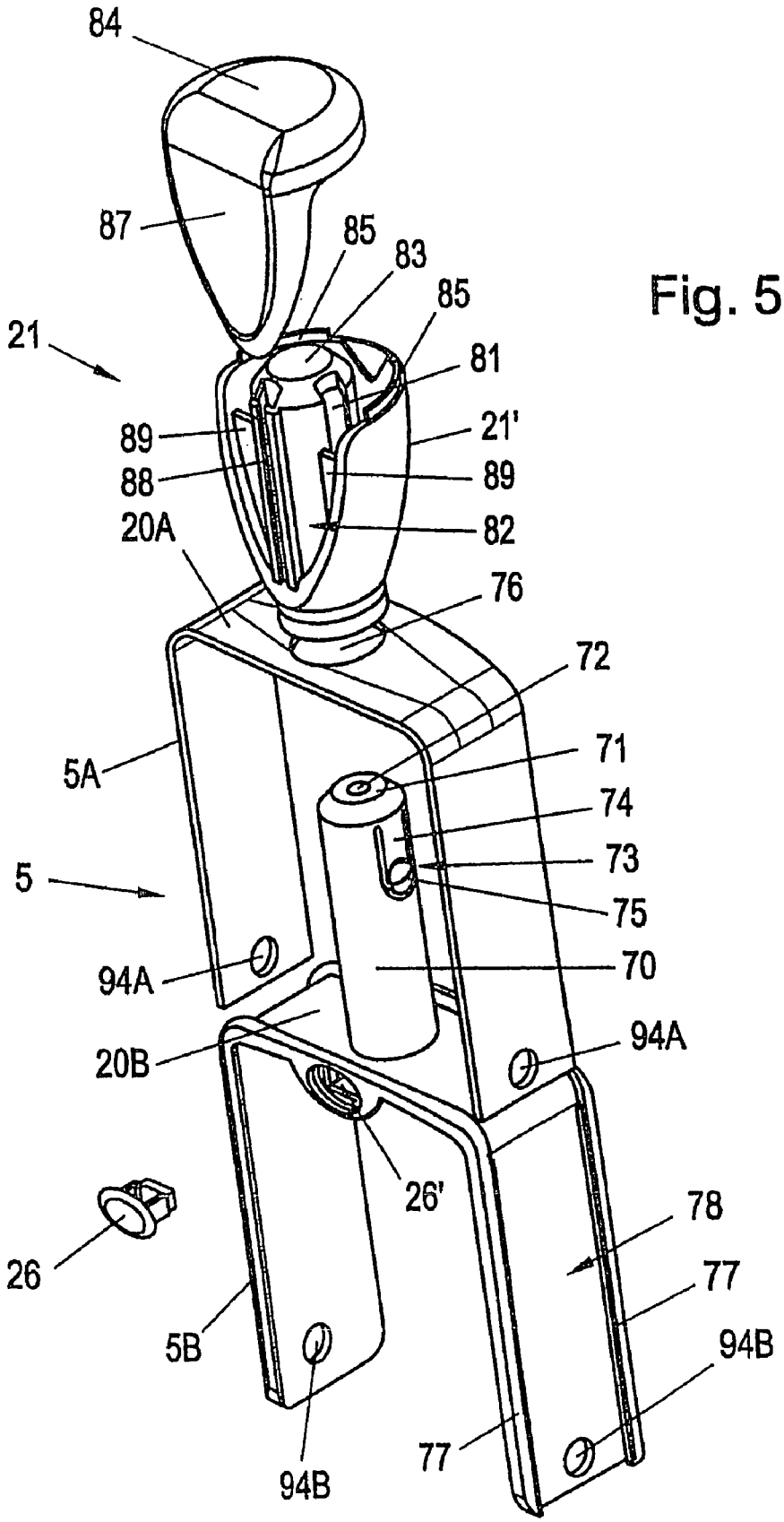
FIG. 5 shows a perspective, explosion view of the parts of an actuating bow designed in several parts, including a handle.

By means of pins 14, the turning members 7 are pivotably mounted in bores 15 (or 15A, 15B, respectively) of the stamp housing 4, and they carry inner pins 16 engaging in lateral guiding grooves 17 of the type unit 3 for turning the type unit 3 during its downward movement with the help of the bow 5 and the turning axle 9, cf. also FIG. 5.

Figure 2:
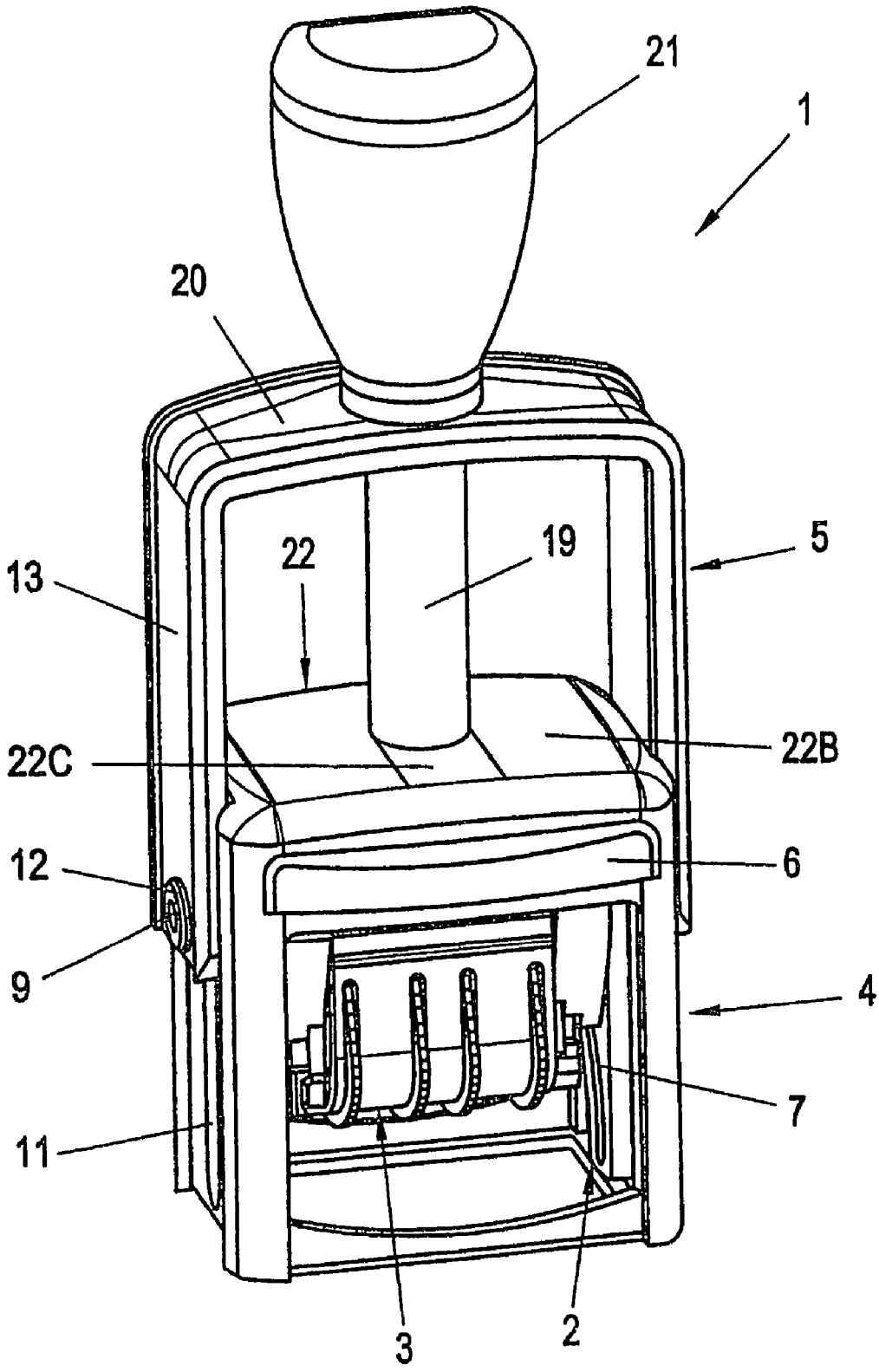
Figure 3:
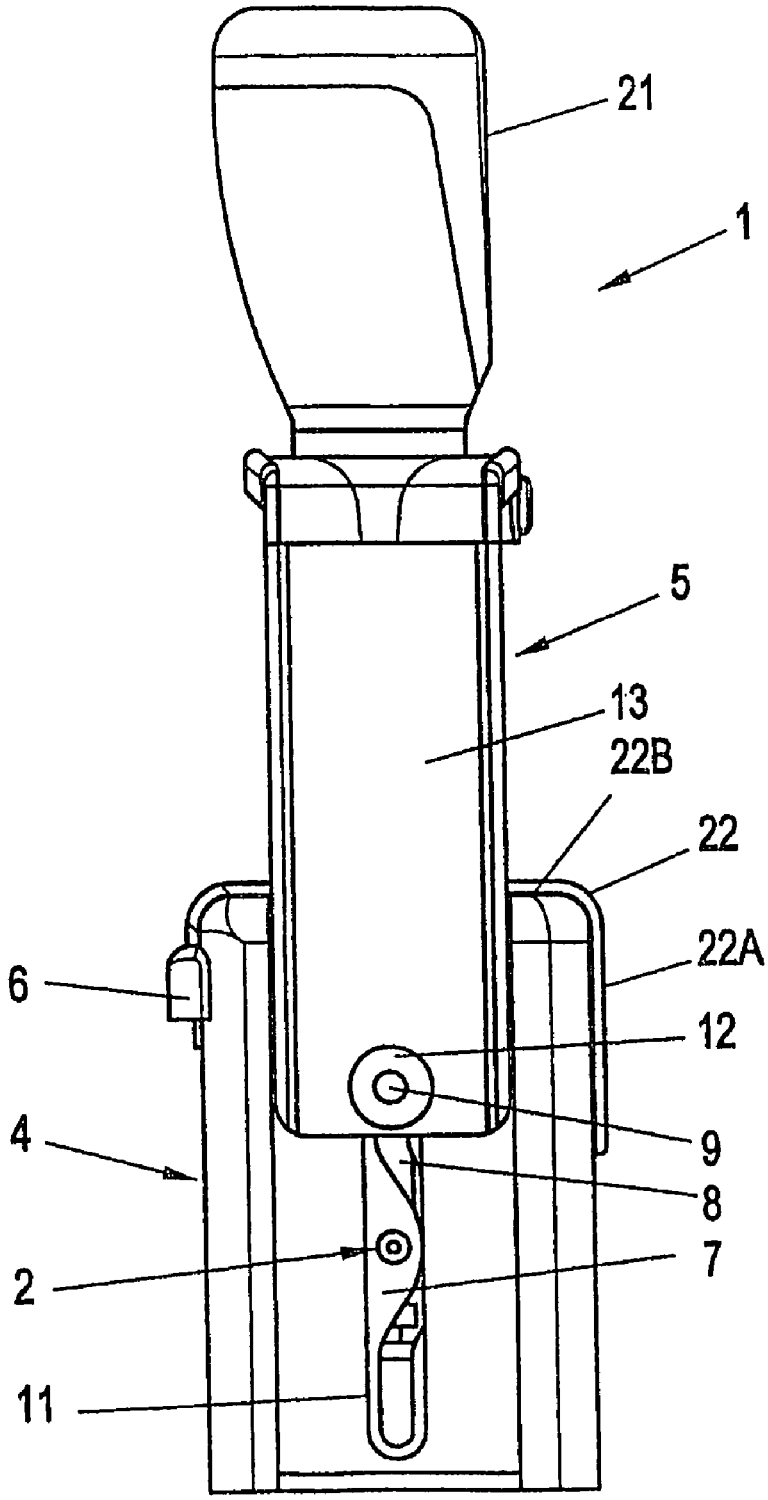
FIG. 3 shows a side view of this self-inking stamp.

By means of a spring 18, in particular a helical compression spring supported on the upper side of the stamp housing 4, the actuating bow 5 is pressed in conventional manner into its upper resting position illustrated in FIGS. 1 to 3, and it is downwardly movable relative to the stamp housing 4 against the force of this spring 18. The spring 18 is accommodated in a tubular member 19 which extends into a handle 21 mounted on the upper side of the actuating bow 5, on the transverse part or web 20 thereof, the handle 21 and the tubular member 19 being telescopically moved within each other during actuation of the stamp 1.

Figure 4:
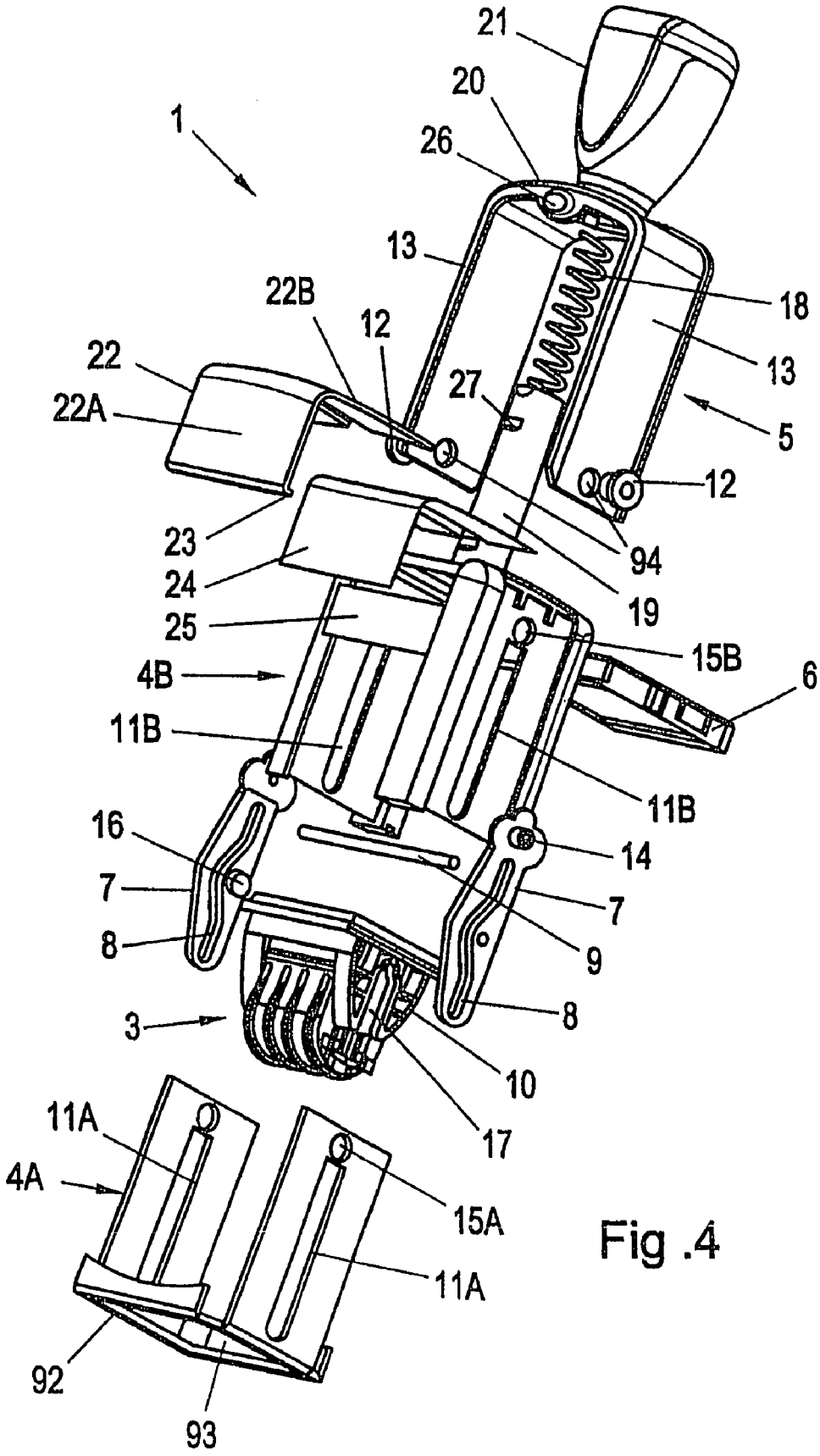
FIG. 4 shows the essential components of such a self-inking stamp in an explosion view.

On the stamp housing 4, furthermore, a text inspection window 22 of angular design with a comparatively large front area 22A and an upper cover area 22B is attached, a slit-shaped recess 22C being provided in said upper cover area 22B so as to be able to slip on the inspection window 22 during attachment on the stamp housing 4, in particular by snapping on with the help of a lower, inwardly projecting snap-in ledge 23 (cf. FIG. 4), despite the tubular member 19, said tubular member 19 being received in this recess 22C in its mounted position, as best visible in FIG. 2. In FIG. 4, moreover, a comparably angularly designed text card 24 having an upper, rear slot is visible, this text card 24 offering a comparatively large area for an imprint—on its front side as well as on its upper side—for applying appropriate information regarding the stamp imprint etc. When attaching it in the inspection window 22, the text card 24 may be inserted by putting it on the snap-in ledge 23 and fixing it together with the latter on the stamp housing upper part 4B by putting it on the upper side thereof as well as by snapping in the snap-in ledge 23 with a transverse web 25 of the stamp housing upper part 4B.

From FIG. 1, finally also a push-button snap-in means 26 provided on bow 5 is visible, which cooperates with notches 27 on the tubular member 19 so as to enable fixing of the actuating bow 5 in the pre-determined position relative to the stamp housing 4, as is known per se.

Similarly as the stamp housing 4, also the actuating bow 5 is comprised of two members one slid over the other, i.e. the upper, or outer, respectively, metal bow part 5A which is U-shaped in elevation, and an lower, or inner, respectively, bow part 5B made of synthetic material which not only has a seat 26' for the push button snap-in member 26 molded to its upper web portion 20B, but, moreover, has a tubular extension 70 on its upper side, which tubular extension is closed on its upper front side, i.e. at its end that faces away from the actuating bow part 5B, by a wall 71 having a central opening 72. This extension 70 is provided with two diametrically oppositely arranged snap-in elements 73 having the shape of snap-in tongues 74 each formed with an outwardly projecting snap-in projection 75 provided on its freely cantilevering lower end, cf. FIGS. 5 and 6.

Figure 6:
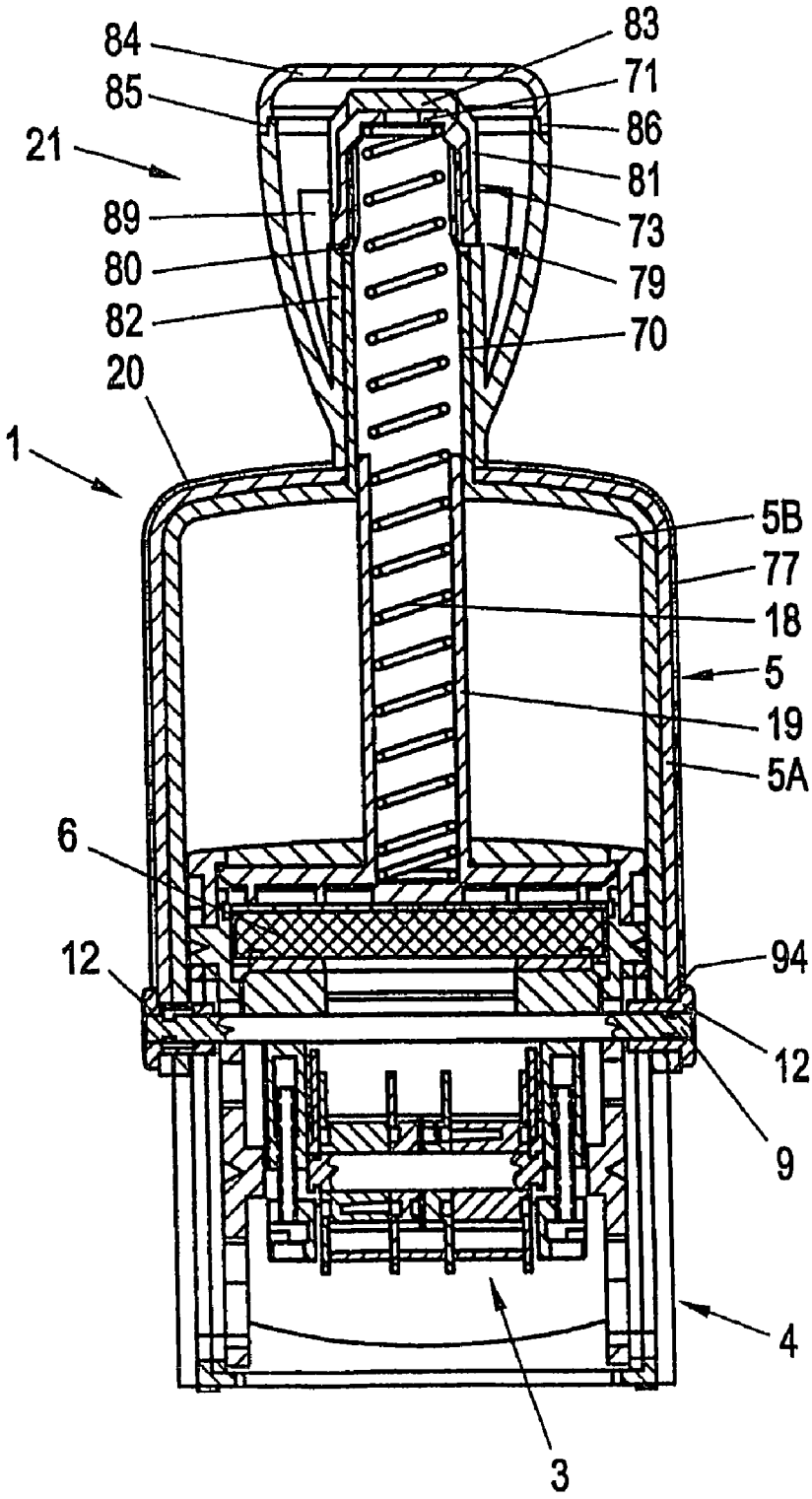
FIG. 6 shows a sectional representation of the self-inking stamp according to FIGS. 1 to 5.

In the assembled state of the actuating bow 5, i.e. when the metal upper bow part 5A of the actuating bow 5 has been slid over the lower bow part 5B, the tubular extension 70 extends through an opening 76 in the upper web part 20A of the metal bow part 5A and into the interior of the handle 21 which is configured as a hollow body 21', cf. particularly also FIG. 6 in addition to FIG. 5. On its front and rear sides, the lower bow part 5B made of synthetic material is provided with guiding ledges 77 embracing the upper metal bow part 5A, which guiding ledges ensure a seat 78 for a firm fit of the upper bow part 5A on the lower bow part 5B and, moreover, cover the sharp edges of the metal upper bow part 5A like a sheathing.

In the mounted position shown in FIG. 6, the snap-in elements 73 on the extension 70 cooperate with corresponding snap-in elements 79 having the form of upwardly-facing rims 80 of the handle 21, these rims 80 being the rims of diametrically oppositely arranged snap-in niches or recesses 81 (cf. FIGS. 5 and 6) in an inner tubular member 82 of the handle 21. Furthermore, this tubular member 82 is closed by a front wall 83 on its side which, according to the illustration of FIGS. 5 to 6, is its upper side that faces away from the actuating member or actuating bow 5. In its mounted state, as illustrated in FIG. 6, this front wall 83 rests on the upper wall 71 of the extension 70 and, thus, additionally stabilizes fastening of the handle.

As is then particularly visible in FIG. 5, in addition to the handle hollow body 21' proper, the handle 21 has a cover 84 snappingly engageable with the former, snap-in ledges 85 provided on the upper front side of the hollow body 21', with an external, bead-shaped snap-in projection not further denoted in the drawing, snapping in a manner known per se in a corresponding groove 86 provided in the wall of the cover 84. The cover 84 has a flat front side 87, cf. FIG. 5, by means of which it is guided along the tubular member 82. For this, a direct contact may be provided, yet also a per se conventional groove and tongue guide may be provided, a corresponding guiding groove 88 being visible on the tubular member 82 in FIG. 5. Such a tongue-and-groove guide including the guiding groove 88 facilitates putting on and snapping on of the cover 84 on the hollow body 21. Nevertheless, the cover 84 may be removed again from the hollow body 21' without any problems by pushing it upwards, whereby an access to the interior of the hollow body 21' of the handle and, thus, to the snap-in elements 73 is provided so that these snap-in elements 73 can be pressed radially inwards to release the snap-in engagement on the rim surfaces 80 of the tubular member 82 and, thus, to enable taking the handle 21, or its hollow body 21', respectively, off the actuating bow 5. Even though an extremely stable snap-in connection is achieved between the handle 21 and the bow 5 by means of the snap-in connection elements described, the handle 21 can easily and comfortably be taken off in this manner and may, e.g., be exchanged for another handle, such as one having a different shape and/or surface.

As furthermore is visible from FIG. 5, the tubular member 82 in the interior of the hollow body 21' of the handle may be connected to the latter via at least substantially radial stiffening webs 89 which, seen in top view, extend approximately in star shape. However, it is preferred to provide the two front webs 89 visible in FIG. 5 eccentrically and in parallel with the front side 87 of the cover 84.

The lower bow part 5B including the extension 70 preferably is integrally produced as an injection-molded member, just like the hollow body 21' of the handle including the inner tubular member 82, with acrylonitrile-butadiene-styrene copolymer (ABS) being used as the synthetic material, e.g., it, however, also being possible to use polyoxymethylene (POM) or a comparable synthetic material.

For supporting the spring 18 on the upper side, in the interior of the handle 21, it would, of course, also be conceivable to provide a web cross or the like instead of the upper wall 71, and of the front wall 83, respectively, additionally supporting the former. In principle, the front wall 83 may be omitted. The tubular part 82 could then be formed as a tube socket, the upper front side of which defines a circumferentially extending upper rim 80 as a snap-in element 79. In terms of their functioning, it is also conceivable to interchange the snap-in elements 73 and 79, i.e. to provide elastically deformable snap-in elements on the tubular member 82 and rigid snap-in surfaces or snap-in depressions cooperating with the former and located on the extension 70. Furthermore, it is, of course, also possible to provide a single-part bow 5, in particular made of synthetic material, optionally also made of metal. The shape of the handle 21 may, e.g., also be cylindrical or spherical etc. in addition to the flattened frusto-conical form shown.

Figure 7:
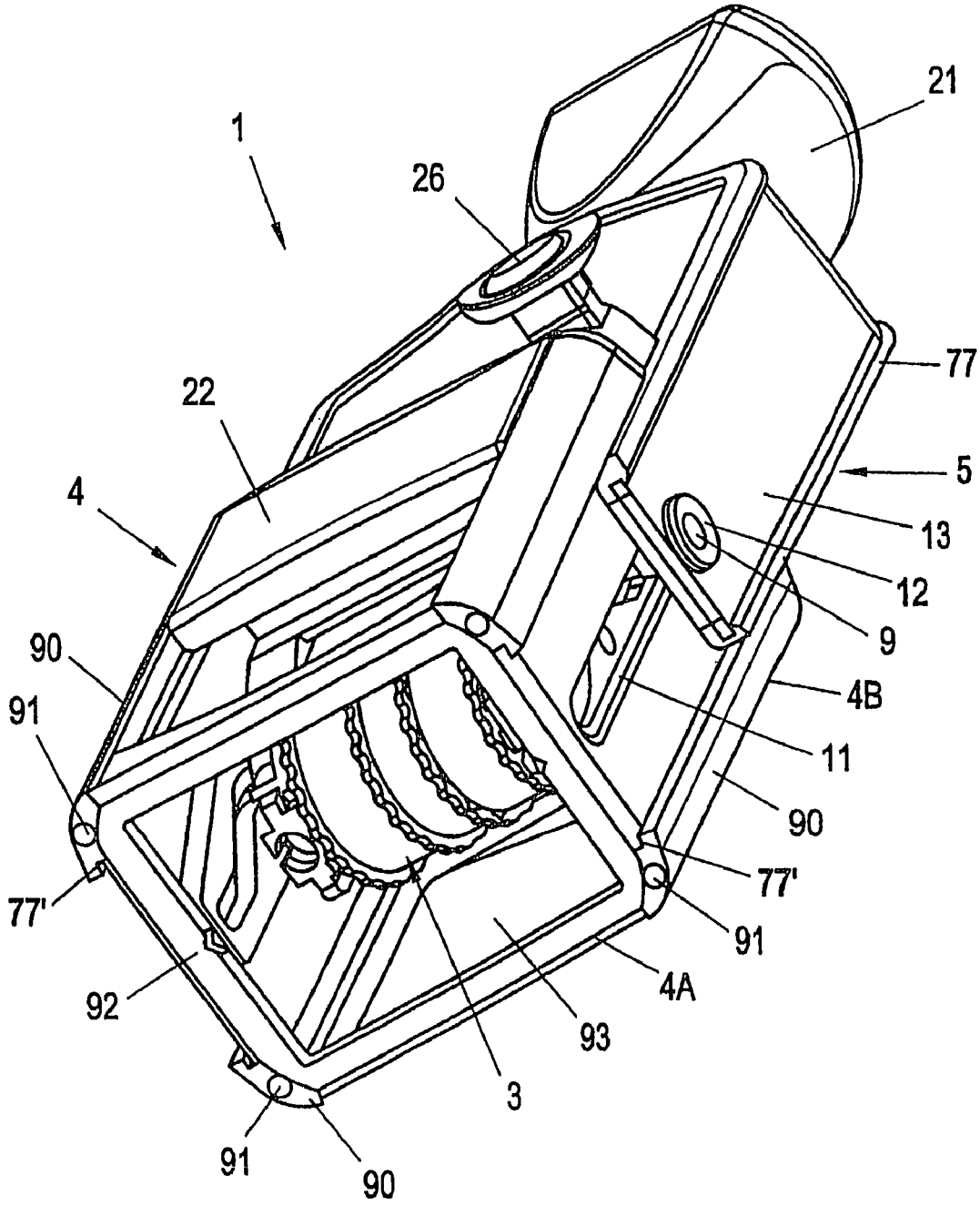
FIG. 7 shows a perspective bottom view of the self-inking stamp according to FIGS. 1 to 6.
Figure 11:
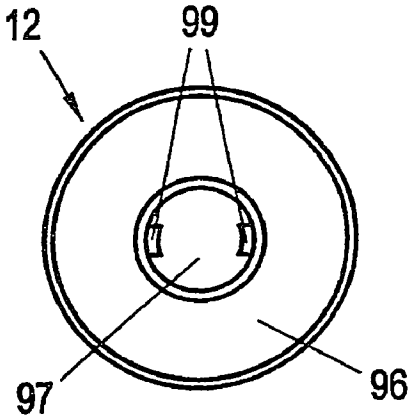
FIGS. 10 and 11 show front views of the axle securing member according to the directions X and XI of FIG. 8.
Figure 8:
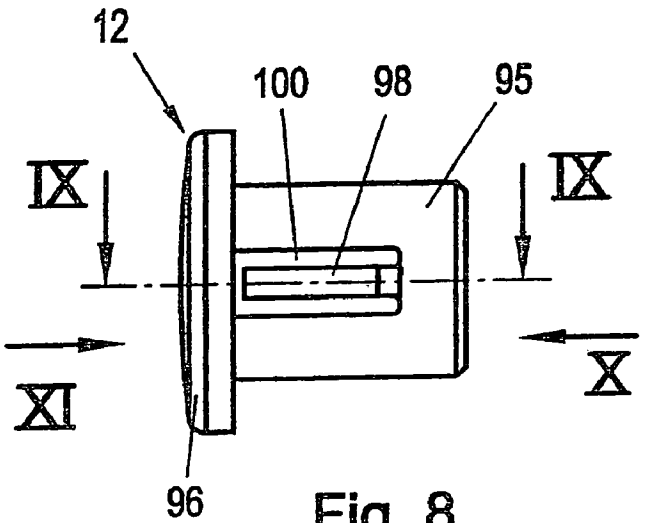
FIG. 8 shows a view of an axle securing member used in the self-inking stamp according to FIGS. 1 to 7.
Figure 9:
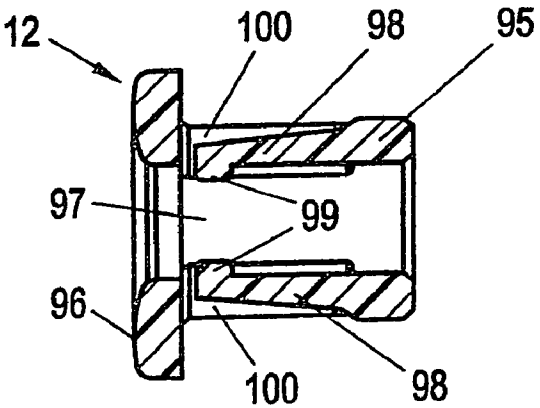
FIG. 9 shows an axial sectional representation of this axle securing member according to FIG. 8.
Figure 10:
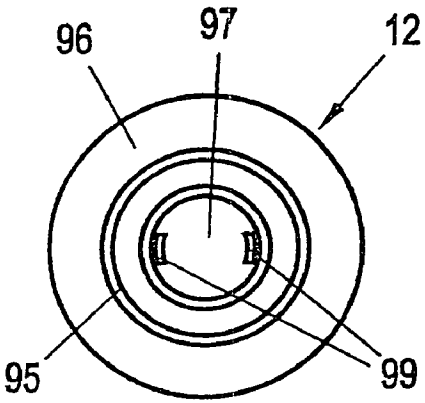

For the sake of completeness, in FIG. 7, the stamp according to FIGS. 1 to 4 is also shown in a perspective bottom view. There, it can be seen that the stamp housing 4, similarly to the actuating bow 5, is assembled of the two parts 4A, 4B such that in the four corner regions 90 of the stamp housing 4 the as such inwardly arranged part 4B made of a synthetic material (cf. FIG. 4) forms an insertion guide for the metal housing part 4A by means of embracing rim ledges 77'. At the same time, the rim ledges 77' in the corner regions 90 of the stamp housing part 4B also form a slide guide for the actuating bow 5 during downward movement of the latter relative to the stamp housing 4 so as to displace and pivot the type unit 3 from the upper resting position or inking position shown into the lower stamp imprinting position. In the corner regions 90 of the synthetic material stamp housing part 4B, on the bottom side thereof, furthermore round anti-skid elements 91 of synthetic material or of rubber are molded or glued on. On account of their high friction, these anti-skid elements 91 prevent an undesired slipping of the stamp housing 4 when put onto a substrate (paper, cardboard, etc.) when making a stamp imprint. Moreover, the corner regions 90 of the housing part 4B made of synthetic material also enable a more pleasant gripping of the stamp housing by covering the—sometimes sharp—edges of the metal stamp housing part 4A.

Finally, from FIG. 7 it can be seen—similarly as from FIG. 4—that the stamp housing 4, or to be more precise, its metal part 4A, with its lower side forms a supporting frame 92 having a rectangular passage opening 93 for the stamp unit 3. However, the supporting frame 92 is not directly put on the respective substrate to be imprinted, but rather via the anti-skid elements 91, as has been mentioned.

In FIGS. 8 to 11, a detail of a bushing-shaped axle securing element 12 is shown, two such axle securing elements 12 being used in openings 94 (FIG. 4), or 94A, 94B (FIG. 5) of the actuating bow 5 for securing the turning axle 9 which passes through the stamp unit 3 as well as through the stamp housing 4. The axle securing element 12 shown consists of a single piece injection-molded part with a substantially sleeve-shaped bushing body 95 as well as of a radial flange projection 96 following thereupon—externally in the operating position. The radial projection 96 encloses the mouth of an opening 97 which extends through the entire axle securing element 12, which opening 97 is substantially circular in cross-section, apart from two diametrically oppositely arranged snap-in projections 99 molded to tongue-shaped snap-in elements 98. Each one of the snap-in elements 98 is kept clear in a window 100, apart from the one end which is inwardly located in the operating position and which joins directly to the remaining bushing body 95. On the other hand, the snap-in projection 99 is molded to the oppositely arranged, freely cantilevering end of the tongue-shaped snap-in element 98 and, in the resting position illustrated in FIG. 9, projects into the interior of the cylinder space defined by the opening 97, cf. also FIGS. 10 and 11. Apart from the region of the tongue-shaped snap-in elements 98, the bushing body 95 forms a bearing surface with its otherwise cylindrical external surface for the rotatable mounting in the respective opening 94, or 94A, 94B, respectively. In this operating position, the radial flange projection 96 contacts the outer side of the actuating part, or actuating bow 5, respectively, as is particularly visible in FIGS. 1, 2 and 7, yet particularly in detail in FIG. 12. In this sectional representation of FIG. 12 which, in detail, is shown on a larger scale, it can also be seen that in the operating position, the tongue-shaped snap-in elements 98 with their snap-in projections 99 are snapped into a snap-in depression 101 which is designed in the form of an annular groove that extends over the entire circumference of the turning axle 9.

The axle-securing member 12 may, e.g., be injection-molded of polyoxymethylene (POM) or of a comparable, relatively hard, resiliently elastic synthetic material. In the operating position shown in FIG. 12, the axle securing member 12 mounts the turning axle 9 rotatably in the actuating member, or actuating bow 5, respectively, and thus, it secures the turning axle 9 against being unintentionally pushed out of the stamp 1 and, moreover, due to the fact that the radial flange projection 96 contacts the outer side of the synthetic material bow part 5A, it also keeps this bow part 5A in abutment against the metal bow part 5B, so that the ends of the bow parts 5A, 5B cannot be unintentionally straddled. On the upper side of the actuating bow 5, its bow parts 5A, 5B are held at each other by means of the web portions 20A, 20B, in that the handle 21 or, more precisely, its hollow body 21', contacts the metal web 20A with its lower side when the hollow body is snapped-on with its tubular member 82 on the extension 70 of the synthetic material bow part 5B.

In principle, it often suffices if the axle securing element 12 has only one tongue-shaped snap-in element 98, and, on the other hand, also more than two such snap-in elements 98, such as three or four, e.g., may be provided. As such, instead of the annular groove, also an appropriate number of discrete, circumferential, bow-shaped snap-in depressions 101 may be provided as said snap-in depression 101, yet in that case, during mounting, when sliding the respective axle securing element 12 onto the turning axle 9 within the openings 94A, 94B, attention must be paid to an appropriate rotating orientation of the two parts 9, 12.

If the snap-in projections 99 at their axial outer side (according to the illustration of FIG. 12, on their left-hand side) are provided with inwardly oriented chamfers or bevels, also the snap-in elements 98 can be released from their snap-in engagement in the snap-in depression 101 in that a thin-walled tubular element is inserted into the opening 97 between the radial flange projection 96 and the turning axle 9, which tubular element will slide over these chamfers in the region of the snap-in projections when impinging on the snap-in tongues and thus will lift the snap-in projections 99 out of the snap-in depression 101.

Figure 12:
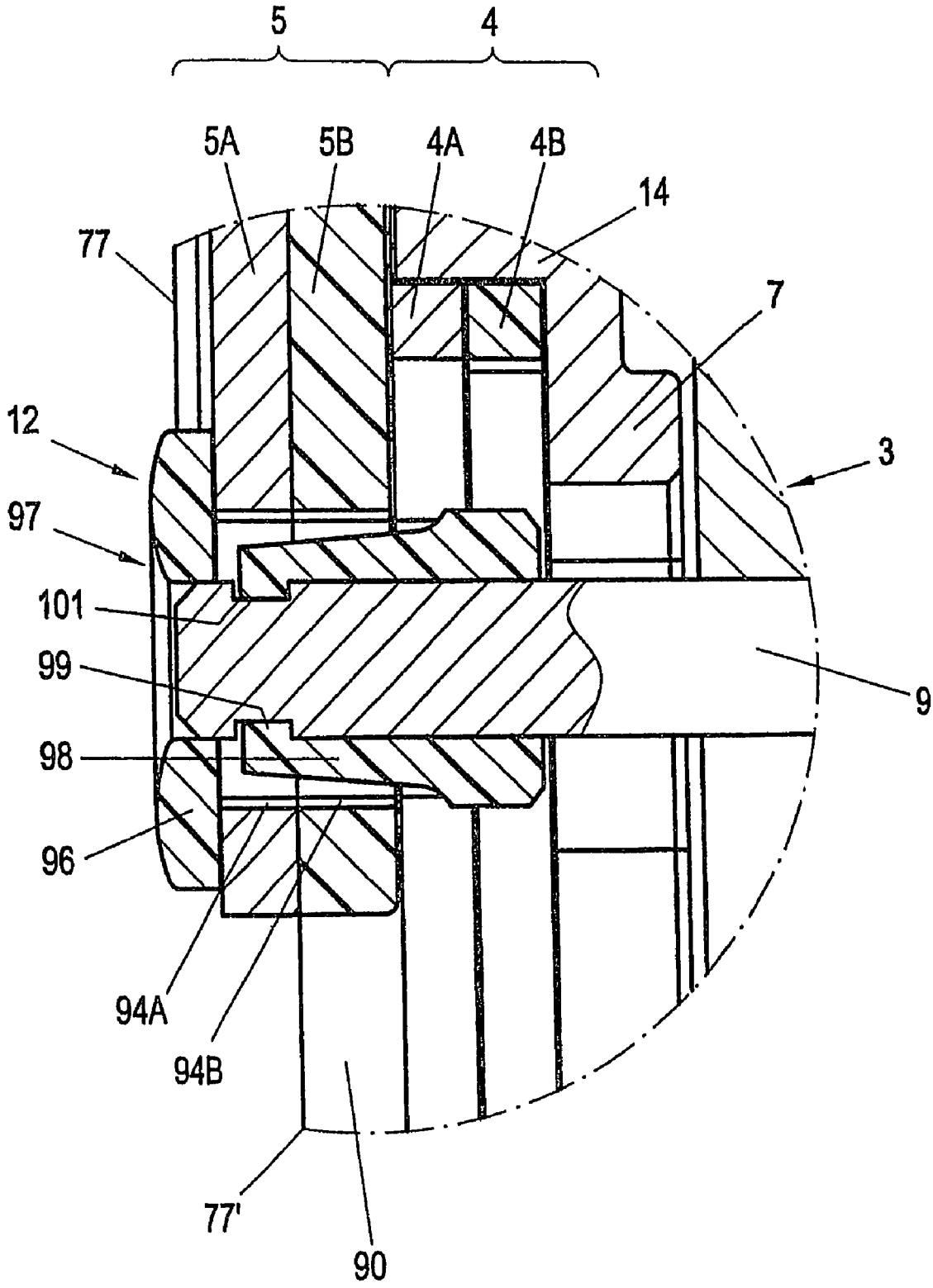
FIG. 12 shows a sectional representation of a detail, similar to FIG. 6, in the region of the axle securing member, according to arrow XII of FIG. 6.

For the sake of completeness it should be noted with regard to FIG. 6 that the—in that illustration—left-hand axle securing element 12 is shown there in a position similar to that in FIG. 12, in which the tongue-shaped snap-in elements (not further denoted in FIG. 6) are visible, whereas on the right-hand side of FIG. 6, the axle securing element 12 is illustrated in a position rotated relative to the former, and from this also the rotatable mounting of the turning axle 9 in the passage openings 94 of the actuating bow is more clearly visible.

The invention claimed is:

1. A device for securing a turning axle (9) of a type unit (3) to an actuating bow (5) of a self-inking stamp (1) having a turning mechanism (2), with at least one bushing-shaped axle-securing member (12) which, in a mounted position, is slid onto an end region of the turning axle (9) with a bushing body (95) and externally contacts the actuating bow (5) with a radial projection (96), wherein the bushing body (95) includes at least one tongue-like, resiliently radially deflectable snap-in element (98) with a radially inwardly oriented snap-in projection (99) which, in the mounted position, engages in a snap-in depression (101) provided as a corresponding snap-in element in the turning axle (9) in the end region of the latter.

2. The device according to claim 1, wherein the tongue-like snap-in element (98) is provided in a window (100) of the bushing body (95) and, at one end thereof, integrally follows upon the bushing body (95).

3. The device according to claim 2, wherein the snap-in projection (99) is provided on a freely cantilevering end of the tongue-like snap-in element (98).

4. The device according to claim 1, wherein the snap-in depression (101) in the turning axle (9) is formed by an annular groove.

5. The device according to claim 1, wherein the turning axle (9) is made of metal, in particular steel.

6. The device according to claim 1, wherein the bushing body (95) has two diametrically oppositely arranged tongue-like snap-in elements (98).

7. The device according to claim 1, wherein the bushing body (95) is integrally formed.

8. The device according to claim 7, wherein the bushing body (95) with the radial projection (96) and the, or each, snap-in element (98) is an injection-molded member.

9. The device according to claim 1, wherein the axle securing member (12) has an opening (97) extending therethrough for its slipping onto the turning axle (9).

10. The device according to claim 1, wherein the actuating bow (5) has two bow parts (5A, 5B) pushed one into the other, the leg ends of which each having passage openings (94A, 94B) for the turning axle (9), wherein the axle securing member(s) slid onto the turning axle (9) simultaneously hold the legs (13) of the bow parts (5A, 5B) against each other.

11. The device according to claim 1, wherein a freely cantilevering end of the tongue-like snap-in elements (98) in the operating position is the outer end of the snap-in element, whereas the tongue-like snap-in element at the further inwardly located end merges integrally with the remaining bushing body (95).

* * * * *

UNITED STATES PATENT AND TRADEMARK OFFICE

CERTIFICATE OF CORRECTION

PATENT NO. : 7,520,221 B2
APPLICATION NO. : 11/794643
DATED : April 21, 2009
INVENTOR(S) : Ameshofer It is certified that error appears in the above-identified patent and that said Letters Patent is hereby corrected as shown below:

Cover page, item [30], please change the country of the Foreign Application Priority data from "(AU)" to correctly read: --(AT)--.

Signed and Sealed this

Twenty-third Day of June, 2009

JOHN DOLL
*Acting Director of the United States Patent and Trademark Office*